US007195480B2

(12) United States Patent
Schuh et al.

(10) Patent No.: US 7,195,480 B2
(45) Date of Patent: Mar. 27, 2007

(54) SHAFT PREHEATER

(75) Inventors: Uwe Schuh, Hamm (DE); Norbert Patzelt, Beckum (DE); Thomas Schmits, Oelde (DE); Heinz Tölke, Oelde (DE); Joachim Kudras, Kamen (DE); Wolfgang Schwab, Duisburg (DE)

(73) Assignee: Polysius AG, Beckum (DE)

( * ) Notice: Subject to any disclaimer, the term of this patent is extended or adjusted under 35 U.S.C. 154(b) by 99 days.

(21) Appl. No.: 10/979,384

(22) Filed: Nov. 2, 2004

(65) Prior Publication Data

US 2005/0098071 A1 May 12, 2005

(30) Foreign Application Priority Data

Nov. 12, 2003 (DE) ..... 103 52 764

(51) Int. Cl.
*F27D 1/12* (2006.01)

(52) U.S. Cl. ..... 432/97

(58) Field of Classification Search ..... 432/95, 432/96, 97, 100; 266/197
See application file for complete search history.

(56) References Cited

U.S. PATENT DOCUMENTS

| | | | | | |
|---|---|---|---|---|---|
| 4,042,226 | A * | 8/1977 | Beggs | 266/88 |
| 4,289,481 | A * | 9/1981 | Yano | 432/96 |
| 4,668,184 | A * | 5/1987 | Dorman | 432/99 |
| 4,797,092 | A * | 1/1989 | Pieper | 432/95 |
| 5,125,943 | A * | 6/1992 | Cole | 65/27 |
| 5,401,166 | A * | 3/1995 | Mallek et al. | 432/96 |
| 5,460,517 | A * | 10/1995 | Scheibenreif et al. | 432/95 |

* cited by examiner

*Primary Examiner*—Gregory Wilson
(74) *Attorney, Agent, or Firm*—Muramatsu & Associates

(57) ABSTRACT

The invention relates to a shaft preheater for preheating material in lump form with at least one shaft for receiving the material, a bridge disposed in the shaft for delivering hot gases which flow through the material from the bottom upwards, and a device for filling the shaft with the material such that the shaft is charged centrally thereby developing a filling cone. The bridge is disposed at an inclination corresponding to the filling cone in order to guarantee an even flow through the fill. The device for filling the shaft comprises a vertically adjustable feed chute.

7 Claims, 3 Drawing Sheets

SHAFT PREHEATER

FIELD OF THE INVENTION

The invention relates to a shaft preheater for preheating material in lump form with at least one shaft for receiving the material as well as a bridge disposed in the shaft for delivering hot gases which flow through the material from the bottom upwards.

BACKGROUND OF THE INVENTION

Known shaft preheaters for preheating material in lump form ahead of downstream kilns frequently consist of a chamber which is formed as an annular shaft and in which the stock which is to be preheated is distributed. The stock is as a rule delivered into the preheater from a silo chamber lying above. The width of the annular shaft is limited to approximately 1.30 m in order to prevent segregation phenomena of the individual grain-size fractions. The preheated stock is discharged from the preheater via a plurality of rams disposed at the circumference. The flue gases from the downstream kilns are generally used for the preheating process by being delivered to the fill via horizontal bridges disposed in the annular shaft. However it has in this case been found that the material is heated relatively unevenly over the depth of the shaft, in particular when the shafts are relatively deep, due to the varying length of the fill through which the flue gases flow.

SUMMARY OF THE INVENTION

The object of the invention is therefore to further develop the shaft preheater so as to enable the material located in the shaft to be preheated as evenly as possible.

The shaft preheater according to the invention for preheating material in lump form consists substantially of at least one shaft for receiving the material as well as a bridge disposed in the shaft for delivering hot gases which flow through the material from the bottom upwards. The bridge is in this case disposed at an inclination.

According to a preferred embodiment, the bridge is disposed at an inclination corresponding to the angle of repose of the material. The length of the fill through which the flue gases flow is thus approximately uniform over the entire depth of the shaft.

According to a further configuration of the invention, a device for filling is provided which is disposed such that the shaft is charged centrally and a filling cone develops in the process. This method of delivering the material into the individual shafts results in the development of the shortest possible slope lengths, so that segregation phenomena of the individual grain-size fractions can largely be prevented. In this configuration the bridge is advantageously formed according to the developing filling cone.

According to a further aspect of the invention, the device for filling the shaft comprises a vertically adjustable feed chute. The mouth of the feed chute is in this case expediently set such that the filling height of the stock in the shaft meets the requirements according to the material grain size and type of material used. The chute is of a length such that it simultaneously serves as an air seal with respect to the flue gases emerging from the preheater shaft.

DETAILED DESCRIPTION OF THE INVENTION

Figure 4:
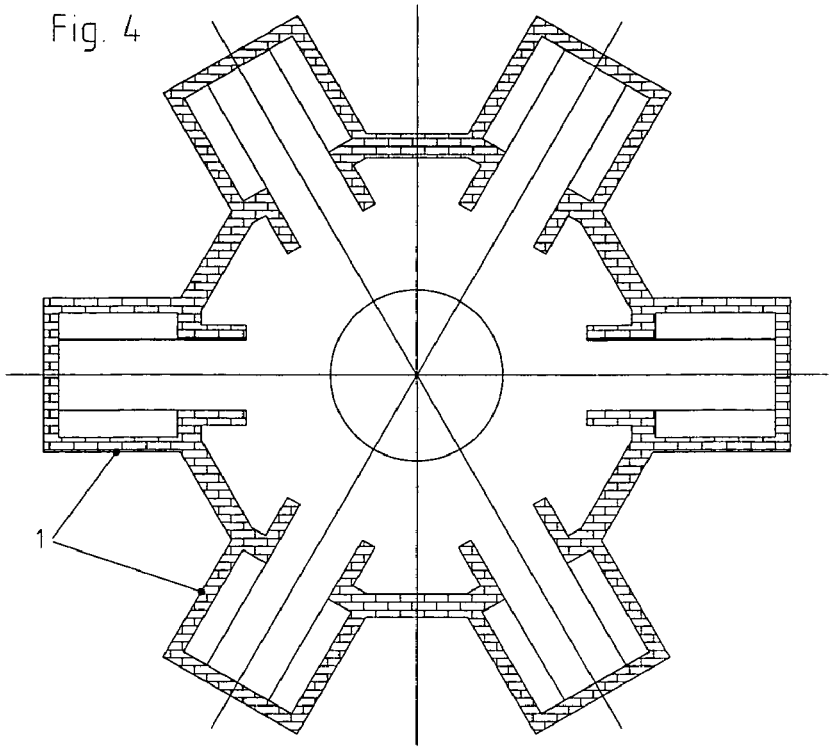
FIG. 4 s a schematic cross-sectional representation of a shaft preheater with six shafts in a round version.
Figure 5:
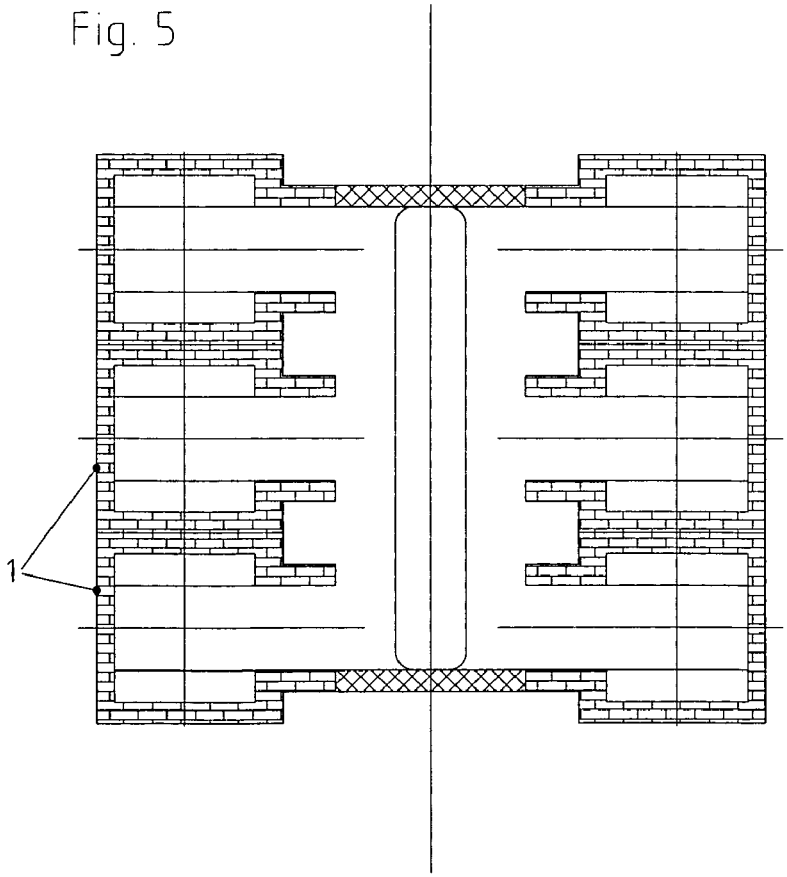
FIG. 5 is a schematic cross-sectional representation of a shaft preheater with six shafts in an angular version.

The shaft preheaters which are represented in FIGS. 4 and 5 each comprise six shafts 1, which are disposed either in a round (FIG. 4) or in an angular (FIG. 5) manner. It is of course also possible to provide a different number of shafts without departing from the scope of the invention. Different arrangements, for example a polygonal arrangement, are also conceivable.

Figure 1:
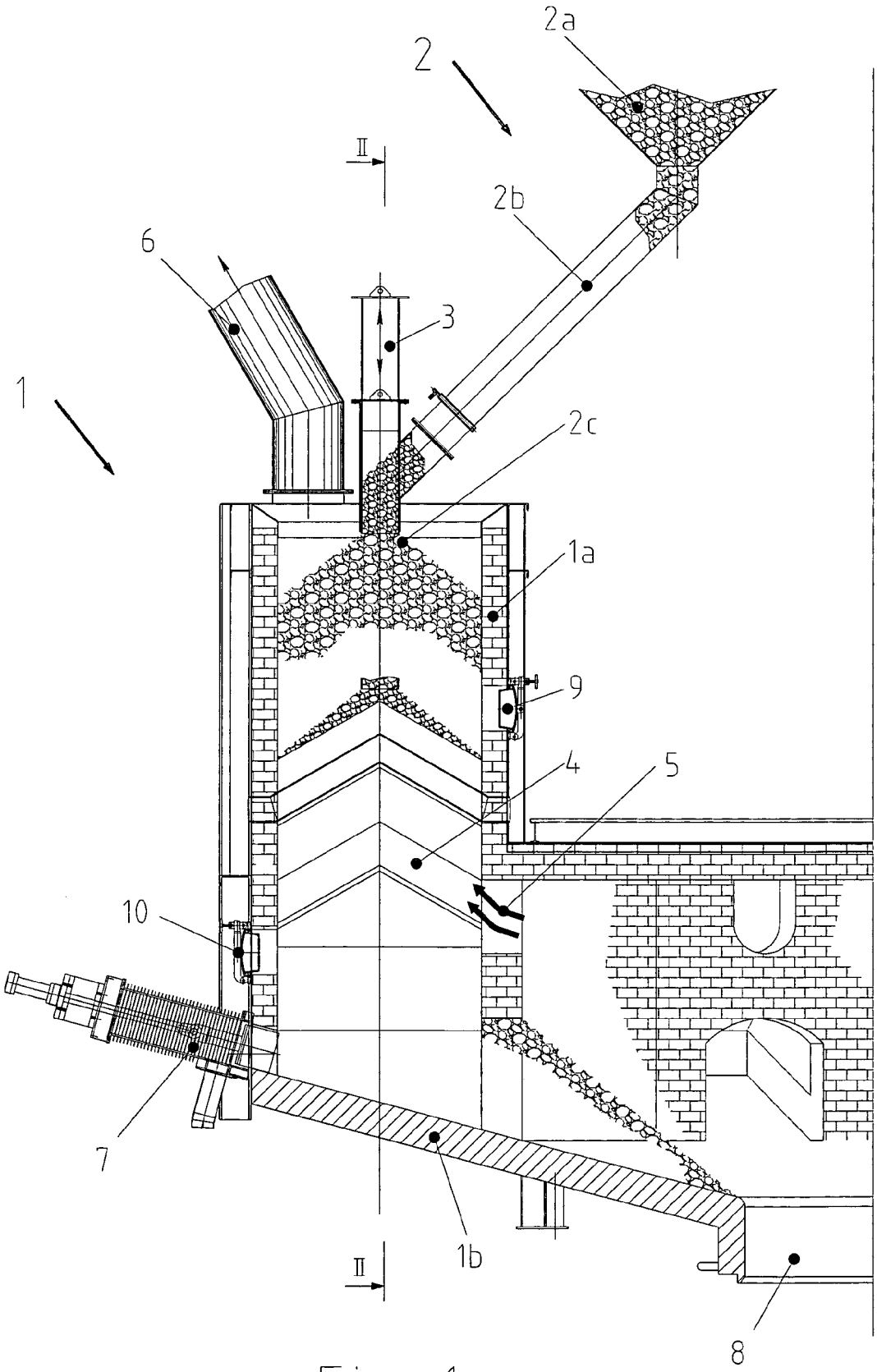
FIG. 1 is a schematic longitudinal sectional representation in the region of a shaft.
Figure 2:
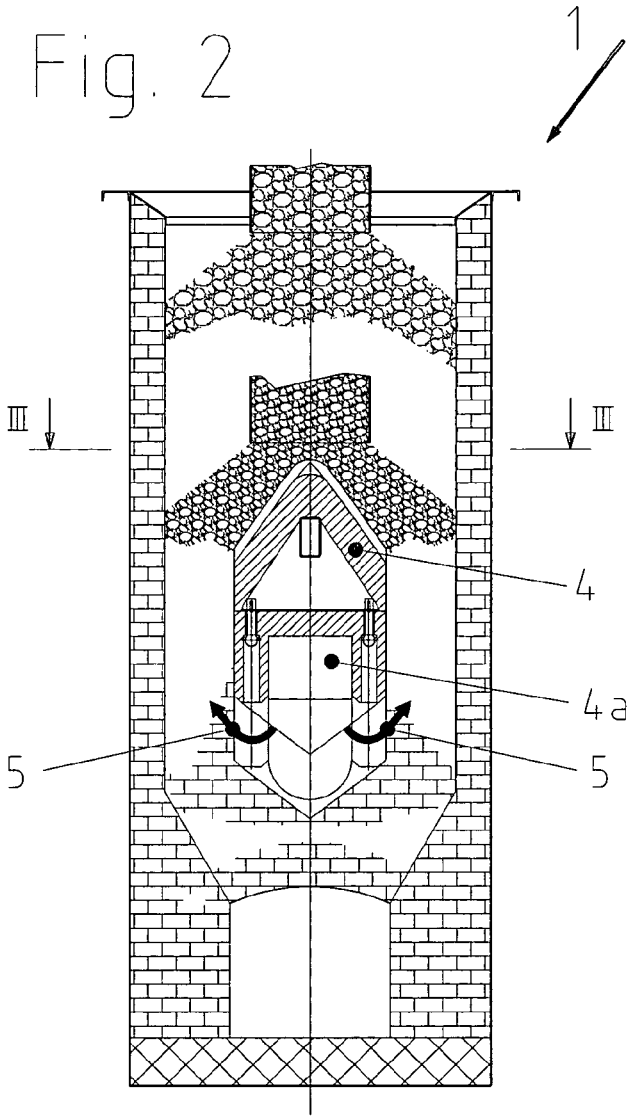
FIG. 2 is a schematic longitudinal sectional representation along the line II—II in FIG. 1.
Figure 3:
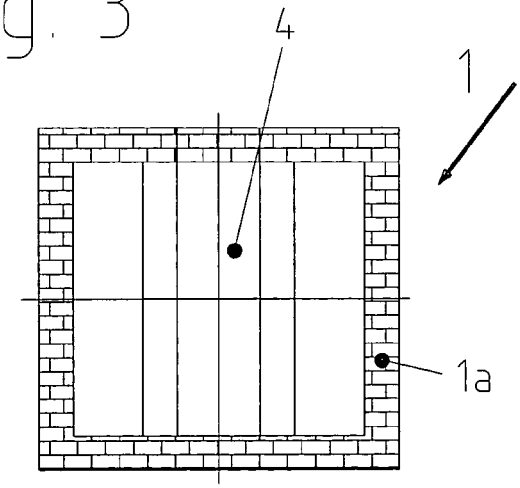
FIG. 3 is a schematic cross-sectional representation along the line III—III in FIG. 2.

One of the shafts is represented in greater detail in FIGS. 1 to 3. In the represented embodiment the shaft 1 has a rectangular cross section. However other shapes would also be conceivable.

The material in lump form which is to be preheated is delivered via a device 2 for filling the shaft. This device consists of a pre-silo 2*a* and a feed chute 2*b*, with the mouth 2*c* of the feed chute 2*b* being vertically adjustable according to the double arrow 3.

A bridge 4, which extends over the entire depth of the shaft 1, is disposed in the lower part of the shaft 1. FIG. 2 shows that this bridge 4 slopes like the ridge of a roof at the top side, so that the material can flow past to the sides. At the underside the bridge 4 forms a U-shaped channel 4*a* which is open towards the bottom. In the region of this U-shaped channel 4*a* the shaft 1 comprises an opening 5 in its outer wall 1*a* via which the hot gases 5, for example of a downstream kiln, are delivered to the U-shaped channel 4*a*. The hot gases 5 emerge at the bottom and then flow upwards through the fill (see FIG. 2).

Means 6 are provided in the upper region of the shaft 1 to carry off the hot gases. The bottom of the shaft 1 is formed by a slope 1*b* which is inclined towards the center of the shaft preheater and on which the preheated material can be conveyed to a central discharge opening 8 with the assistance of a ram system 7 which can be actuated.

FIG. 1 also shows two inspection holes 9 and 10 at different heights of the shaft. The shaft 1 is charged centrally via the feed chute 2*b*, so that a filling cone develops according to the type of material and material grain size used. This results in the shortest possible slope lengths, so that it is largely possible to prevent segregation phenomena of the individual grain-size fractions when delivering the stock into the individual shafts.

Because of the vertically adjustable feed chute 2*b*, the mouth 2*c* can always be brought into line with the tip of the filling cone. The chute 2*b* thereby simultaneously also provides an air seal with respect to the hot gases 5 emerging from the preheater shaft. The bridge 4, which extends over the entire depth of the shaft, is inclined relative to the horizontal.

In order to obtain flow-through lengths which are as uniform as possible, the inclination of the bridge is expediently adapted according to the angle of repose of the material. The bridge therefore extends from the center of the shaft obliquely downwards on both sides to the respective outer wall.

Otherwise the bridge is configured such that the hot waste gases are introduced into the fill in such a way that the gases are distributed as evenly as possible over the width and depth of the shaft.

The gases emerging from the fill are collected in the upper part of the shaft, drawn off via the means 6 and delivered to a collecting main which connects all the shafts. From here the hot gases, in particular the flue gases of a downstream kiln, can be passed on to a dust removal device.

Although the invention is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A shaft preheater for preheating material in lump form, comprising:

at least one shaft for receiving the material;

a bridge disposed in the shaft for delivering hot gases which flow through the material from the bottom to the top; and a device for filling the shaft with the material, the device being disposed such that the shaft is charged centrally thereby developing a filling cone;

wherein the bridge is disposed at an inclination corresponding to the filling cone, and wherein the device for filling the shaft comprises a vertically adjustable feed chute.

2. A shaft preheater according to claim 1, wherein the bridge is disposed at an inclination corresponding to the angle of repose of the material.

3. A shaft preheater according to claim 1, further comprising means for carrying off the gases and a delivery chute for filling the shaft with material in lump form, a mouth of the chute being vertically adjustable.

4. A shaft preheater according to claim 1, wherein the bridge is formed such that the hot gases are distributed evenly over width and depth of the shaft.

5. A shaft preheater according to claim 1, wherein the bridge extends over an entire depth of the shaft.

6. A shaft preheater according to claim 1, wherein a plurality of shafts are provided, these being disposed side-by-side and each comprising a device for centrally filling the shaft.

7. A shaft preheater according to claim 1, further comprising a separate ram system associated with each shaft for discharging the preheated material.

* * * * *

UNITED STATES PATENT AND TRADEMARK OFFICE

CERTIFICATE OF CORRECTION

PATENT NO. : 7,195,480 B2
APPLICATION NO. : 10/979384
DATED : March 27, 2007
INVENTOR(S) : Schuh et al.

It is certified that error appears in the above-identified patent and that said Letters Patent is hereby corrected as shown below:

Title Page (75) Inventors: change “Thomas Schmits” to --Thomas Schmitz--.

Signed and Sealed this

Tenth Day of July, 2007

JON W. DUDAS
*Director of the United States Patent and Trademark Office*